United States Patent [19]

Blair, Jr. et al.

[11] Patent Number: 4,862,122

[45] Date of Patent: Aug. 29, 1989

[54] DIELECTRIC NOTCH FILTER

[75] Inventors: William D. Blair, Jr., Lanoka Harbor; Salvatore Bentivenga, Manalapan; Gregory J. Lamont, Englishtown, all of N.J.

[73] Assignee: Alcatel NA, Inc, Claremont, N.C.

[21] Appl. No.: 284,334

[22] Filed: Dec. 14, 1988

[51] Int. Cl.[4] ..... H01P 1/20

[52] U.S. Cl. ..... 333/202; 333/212; 333/219.1; 333/235

[58] Field of Search ..... 333/202, 219, 219.1, 333/207, 208, 210, 212, 222–234, 235; 331/96

[56] References Cited

U.S. PATENT DOCUMENTS

| | | | |
|---|---|---|---|
| 4,028,652 | 6/1977 | Wakino et al. | 333/235 X |
| 4,241,322 | 12/1980 | Johnson et al. | 333/233 X |
| 4,692,723 | 9/1987 | Fiedziuszko et al. | 333/212 X |

*Primary Examiner*—Eugene R. LaRoche
*Assistant Examiner*—Seung Ham
*Attorney, Agent, or Firm*—Peter C. Van Der Sluys

[57] ABSTRACT

A dielectric notch filter for attenuating frequencies of relatively narrow bandwidth in comparison to the center frequency of operation, and particularly for attenuating such narrow bandwidths in the ultra-high frequency electromagnetic spectrum. The dielectric notch filter comprises a plurality of dielectric notch resonators coupled to a transmission line at slightly less than the quarter wavelength of the center frequency of the attenuation frequency bandwidth so as to minimize interaction between the individual dielectric notch resonators. Each dielectric notch resonator comprises a dielectric resonator, an associated housing and a coupling reactance element which in turn comprises an inductive wire and a variable capacitor so as to null the reactive component of the dielectric resonator, thereby resulting in a highly attenuated resonant frequency having little imaginary component about said center frequency. By use of a plurality of such dielectric notch resonators, a bandwidth of frequencies can be attenuated through coupling of each resonator to the transmission line.

45 Claims, 4 Drawing Sheets

FIG. 2
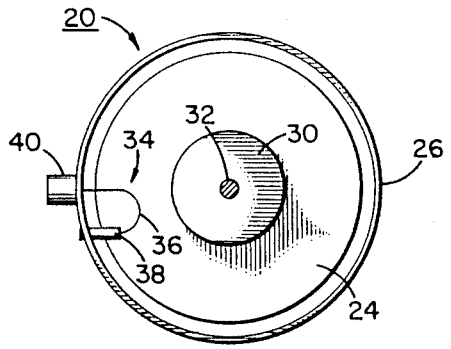
FIG. 1
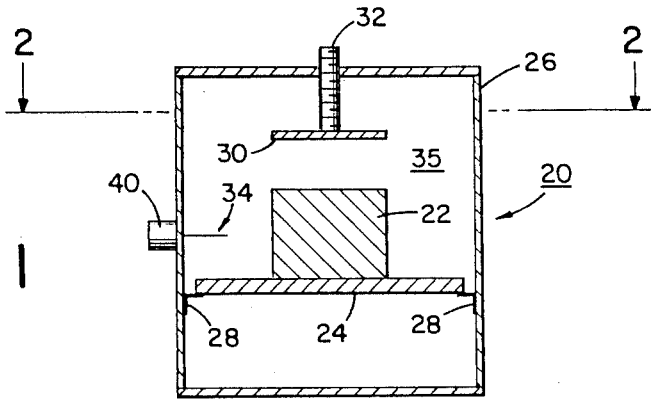
FIG. 3A
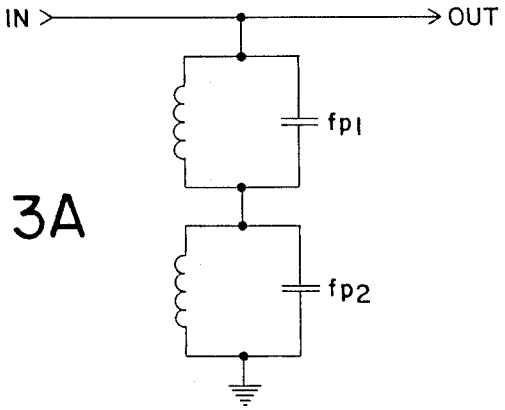
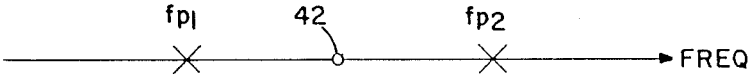
FIG. 3B

FREQS OF INDIVIDUAL REJECT NOTCHES 1. 845.3275 MHz
2. 845.4250 MHz
3. 845.6125 MHz
4. 845.8295 MHz
5. 846.0505 MHz
6. 846.2130 MHz

DIELECTRIC NOTCH FILTER

TECHNICAL FIELD

The present invention relates to filters for attenuating the reception of electromagnetic energy within a given bandwidth, wherein the bandwidth represents a relatively small percentage of the center frequency of the attenuated energy. The invention is particularly directed to dielectric notch filters for attenuating signals in the ultra-high frequency range with attenuation bandwidths of less than 1% of the central frequency being attenuated.

BACKGROUND OF THE INVENTION

The Federal Communication Commission (FCC) originally allocated frequencies of 870–890 megahertz (mhz) for transmission and 825–845 mhz for reception of cellular communications. The channel bandwidth was chosen at 30 kilohertz (khz) with transmission, reception separation at 45 mhz. During this initial allocation of frequencies, the FCC further sub-divided the receive and transmit bands into ten megahertz sub-bands designated as non-wireline and wireline sub-bands. The non-wireline service is typically provided by any private entrepreneur who has obtained licensing rights through the FCC and other governmental agencies. The wireline service is provided by the regional telephone company where the cellular communications are resident. In any region where cellular service is to be provided, it can be served by one non-wireline service and one wireline service.

The sub-bands for reception were divided into 825–835 mhz for non-wireline service and 835–845 mhz for wireline service. Similarly, the transmit sub-bands were divided into 870–880 mhz for non-wireline service and 880–890 for wireline service.

This early allocation of frequencies for cellular communications was found to be inadequate and recently the FCC increased the allocation of frequencies for receive and transmit from twenty megahertz to 25 megahertz. Specifically the receive band was extended to cover 824 mhz to 849 mhz and the transmit band extended to cover 869 mhz to 894 mhz. In order to maintain compatibility with existing equipment, the sub-bands for non-wireline and wireline services had this additional 5 megahertz bandwidth for both receive and transmit split between the non-wireline and wireline services and further, the original sub-band frequencies were not changed. As a result, the non-wireline receive band originally set at 825 to 835 mhz was extended into two receive sub-bands; namely, 824 to 835 mhz and 845 to 846.5 mhz, while the wireline receive sub-band was extended from 835 to 845 mhz to that sub-band plus a sub-band residing between 846.5 and 849 mhz. A similar reallocation of the transmit sub-bands was also made resulting in the non-wireline transmit sub-bands from 869 to 880 mhz and 890 to 891.5 mhz, and wireline transmit sub-bands from the original 880 to 890 mhz and 891.5 to 894 mhz.

As a result of this increase in bandwidth and the resulting addition of two additional sub-bands for reception and transmission, a means for filtering unwanted frequencies for both the non-wireline and wireline services became critical. In particular, with regard to the wireline service, the additional non-wireline 1.5 mhz sub-band which lies between the two wireline sub-bands must be effectively attenuated for wireline reception.

The present invention is a dielectric notch filter which has the desired characteristics of presenting a relatively low impedance having a primarily resistive characteristic within a fairly narrow bandwidth of frequencies while maintaining a relatively small physical size in comparison to other filters. This dielectric notch filter has a high quality factor so as to present little attenuation outside of the desired filtered frequencies.

In particular, the dielectric notch filter described herein uses one or more dielectric notch resonators as set forth in the simultaneously filed co-pending application Ser. No. 284,341 of the present inventors assigned to the same assignee, entitled "DIELECTRIC NOTCH RESONATOR". This application is hereby incorporated by reference.

The dielectric notch filter is achieved by placing these dielectric notch resonators onto a coupling transmission line between the receiver and the antenna so that the dielectric notch resonators are spaced at approximately odd multiples of quarter wavelengths at the frequency of operation. In this manner, interaction between the individual dielectric notch resonators is minimized while each resonator is able to attenuate a band of frequencies about its own center frequency.

The overall result is a dielectric notch filter which can attenuate a desired bandwidth of frequencies such as those described above with regard to cellular communications.

SUMMARY OF THE INVENTION

A dielectric notch filter is disclosed which is particularly suited for attenuating relatively narrow bandwidths of ultra-high frequency electromagnetic energy such as that used in cellular communication receivers. One such bandwidth is between 845 and 846.5 mhz. The dielectric notch filter uses a plurality of dielectric notch resonators connected to a coupling transmission line at distances so as to minimize interaction between the individual resonators while performing a high quality factor (Q) attenuation of desired frequencies. The actual spacing of the resonators on the transmission line is slightly less than the quarter wavelength distance of the center frequency to be attenuated due to transmission line effects.

The dielectric notch filter incorporates dielectric notch resonators as set forth in the co-pending application of the present inventors (see above). Each such dielectric notch resonator incorporates a dielectric resonator and a coupling reactance mechanism so as to present a low real impedance about a narrow bandwidth of frequencies.

OBJECTS OF THE INVENTION

It is a principal object of the present invention to provide a dielectric notch filter incorporating a plurality of dielectric notch resonators spaced on a transmission line at approximate odd multiples of quarter-wavelength of the frequency of operation so as to achieve a band reject filter over a relatively narrow bandwidth operating at ultra-high frequencies.

An additional object of the present invention is to provide a dielectric notch filter comprising a plurality of dielectric notch resonators coupled to a network whose transmission phase response is an odd multiple of 90 degrees at the frequency of operation.

A still further object of the present invention is to provide a dielectric notch filter incorporating dielectric notch resonators, each adjustable as to its center frequency of operation so as to produce an equal ripple voltage response in the band of frequencies to be attenuated.

Other objects of the present invention will in part be obvious and will in part appear hereinafter.

BRIEF DESCRIPTION OF THE DRAWINGS

For a fuller understanding of the nature and obviousness of the present invention, reference should be made to the following detailed description taken in connection with the accompanying drawings, in which which:

FIG. 1 is a cross-sectional side elevational view of a dielectric notch resonator used in the present invention to form a dielectric notch filter.

FIG. 2 is a cross-sectional view of the dielectric notch resonator taken along line 2—2 in FIG. 1.

FIG. 3A is an equivalent circuit of the dielectric notch resonator shown in FIGS. 1 and 2.

FIG. 3B is a reactance diagram of the dielectric notch resonator having the equivalent circuit shown in FIG. 3A.

BEST MODE FOR CARRYING OUT THE INVENTION

Figure 6:
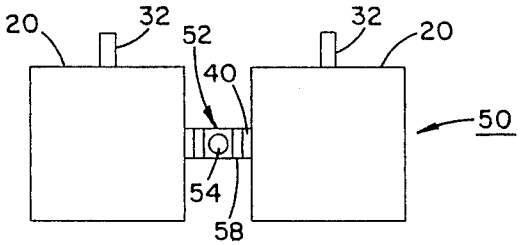
FIG. 6 is a side elevational view of the dielectric notch filter shown in FIG. 5 taken along line 6—6 thereof.
Figure 5:
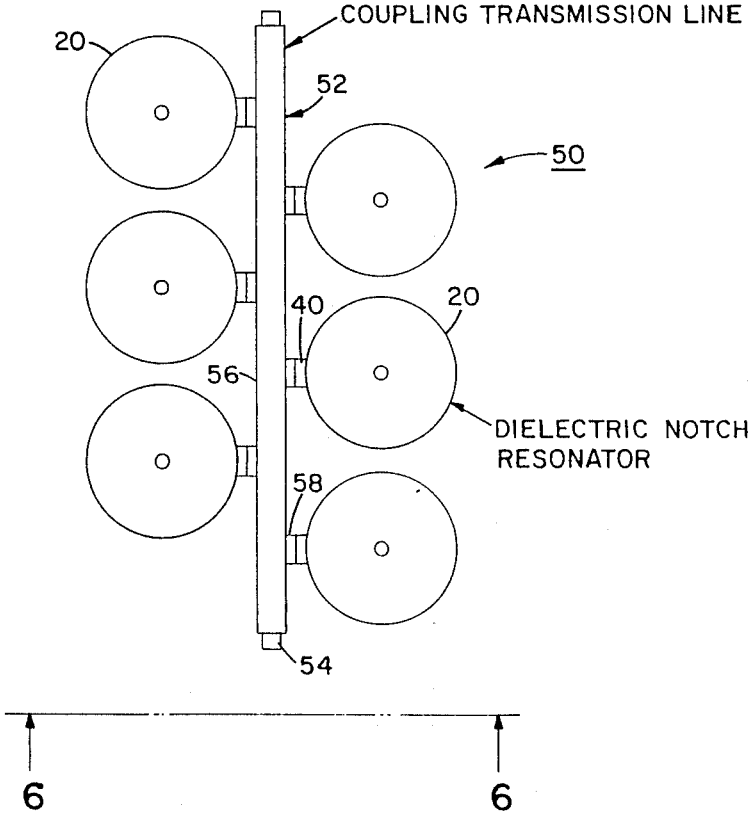
FIG. 5 is a diagrammatic top plan view of the dielectric notch filter according to the present invention showing a plurality of the dielectric notch resonators connected to a coupling transmission line.

The present invention is directed to a dielectric notch filter 50 as best seen in FIGS. 5 and 6. The filter comprises a plurality of dielectric notch resonators 20 as shown in FIGS. 1 and 2. These dielectric notch resonators are disclosed in applicant's co-pending application entitled DIELECTRIC NOTCH RESONATOR filed on the same date as the present application, and assigned to the same assignee. The subject matter of this co-pending, simultaneously filed application is incorporated by reference.

As seen in FIGS. 1 and 2, the dielectric notch resonator 20 comprises a cylindrically shaped dielectric resonator 22 mounted on a low dielectric constant, low-loss platform 24 which in turn is mounted to a cylindrically shaped housing 26 by means of support brackets 28. The dielectric resonator is preferably made from a ceramic material such as zirconium tin titanate while the mounting base can be made from a material such as cross-linked polystyrene sold under the Rexolite trademark of the General Electric Corporation.

Fine tuning of the center frequency of the dielectric notch resonator is accomplished through use of a tuning disc 30 made from a conductive material such as copper, with the diameter of this disc approximately the same as the cross-sectional diameter of the dielectric resonator 22. The height of disc 30 with respect to dielectric resonator 22 is adjustable by means of screw 32, which in turn adjusts the center frequency of the resonator.

A coupling mechanism 34 comprises an inductive wire loop 36 and a capacitive element 38. This mechanism nulls the reactive component of the dielectric resonator. The capacitive element is typically a variable capacitor with a range of values of 0.6 to 6 picofarads for the embodiment of the dielectric resonator shown in FIGS. 1 and 2. In this embodiment, a center frequency of approximately 845 megahertz (mhz) is described and the dielectric resonator for such an implementation has a diameter of 2.75 inches (6.99 cm), a height of 1 inch (2.54 cm), while the cylindrical housing has a diameter of 5 inches (12.7 cm) and a height of 5 inches (12.7 cm).

Figure 4:
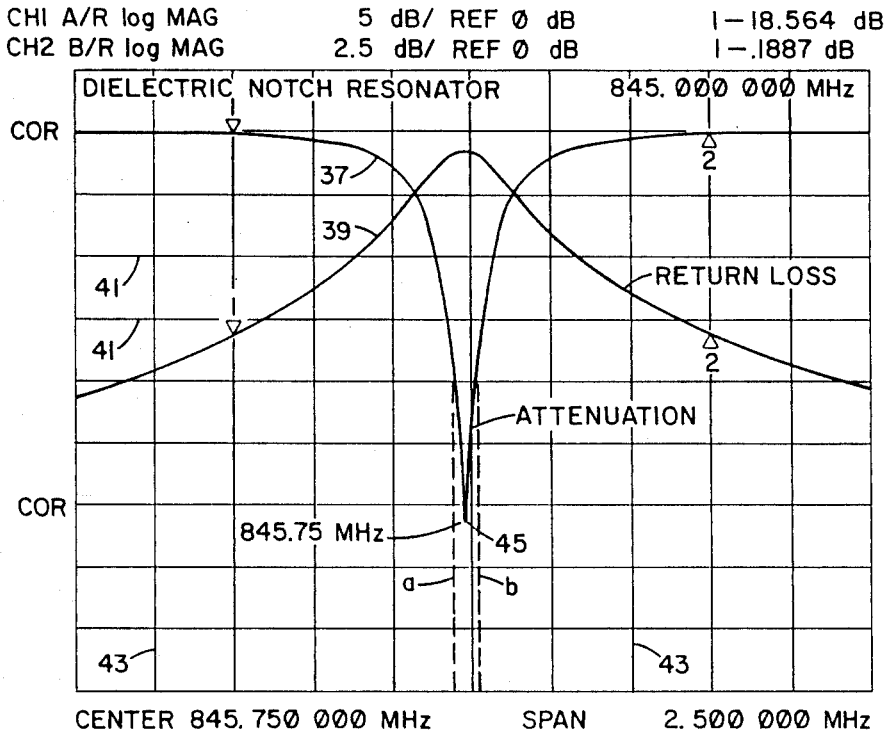
FIG. 4 is a typical response curve of the dielectric notch resonator shown in FIGS. 1 and 2 illustrating both attenuation and return loss as a function of frequency.

The equivalent circuit for the dielectric notch resonator is shown in FIG. 3A. A corresponding reactance diagram is shown in FIG. 3B. The response curve of the notch resonator is shown in FIG. 4. Curve 37 represents the attenuation of the output signal from the resonator as compared to the input signal. This attenuation is measured in decibels (dB) with each horizontal line 41 representing a change of 2.5 dB for curve 37. Vertical lines 43 each represent a change of 0.25 mhz. It is seen in FIG. 4 that the maximum attenuation at point 45 is 15.75 dB.

Curve 39 in FIG. 4 represents what is known as the return loss of the dielectric notch resonator. By definition, the return loss is:

Return loss=20 log 1/(*abs*(*reflection coefficient*)), where the reflection coefficient is equal to zero for a perfect match (no reflection at the interface) and is equal to one if the incoming signal is completely reflected back to the source at the interface. For filtering applications, it is desired that the return loss be greater than approximately 15 for regions where attenuation is not desired (where filtering is not desired) and be as close to zero where attenuation (filtering) is desired. Horizontal lines 41 for curve 39 are in units of 5 dB. It is seen in FIG. 4 that the response curve for the individual dielectric notch resonators can be made symmetric through adjustment of capacitor 38. The depth of maximum attenuation is adjustable by physically altering the orientation of coupling wire 36 within air space 35.

As described above in the background art section, in cellular communications there is a span from 845 to 846.5 mhz which is dedicated for use in non-wireline service reception. This bandwidth of frequencies needs to be suppressed from the 835–845 mhz and the 846.5–849 mhz sub-bands used in reception of wireline cellular communications. The 845–846.5 mhz dielectric notch filter 50 is illustrated in FIGS. 5 and 6 using the dielectric notch resonators described above. The spacing between adjacent dielectric notch resonators 20 on coupling transmission line 52 is approximately 3.0 inches (7.62 cm) which represents approximately 85% of the quarter wavelength at 845.75 mhz (center frequency of the 845–846.6 mhz band).

Figure 7:
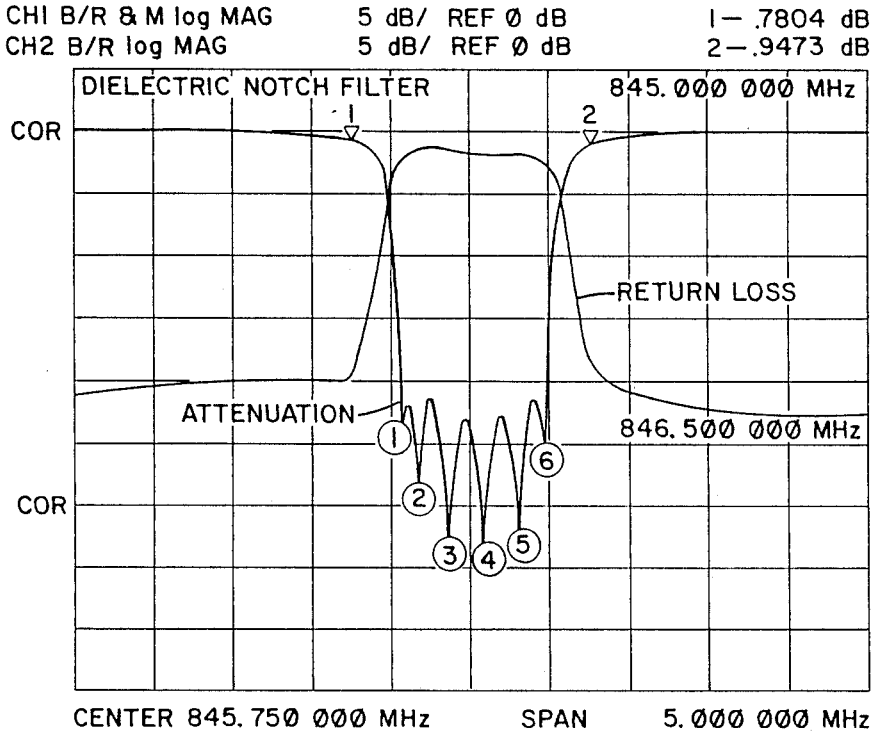
FIG. 7 is a response curve of the dielectric notch filter shown in FIGS. 5 and 6 using dielectric notch resonators with individual center frequencies spanning the overall desired attenuation notch, illustrating both attenuation and return loss as a function of frequency.

As seen in FIG. 4, the attenuation of each dielectric notch resonator is quite sharp about its center frequency and maintains approximately a 10 dB attenuation about 0.1 mhz on each side of the center frequency as shown by lines a and b. In order to obtain a 1.5 mhz attenuation bandwidth of at least 20 dB, six dielectric notch resonators are used with center frequencies at 845.3275 mhz, 845.4250 mhz, 845.6125 mhz, 845.8295 mhz, 846.0505 mhz and 846.2130 mhz. FIG. 7 illustrates the overall response curve for the dielectric notch filter. It should be noted that the resultant attenuation of the filter is greater than that of any individual dielectric notch resonator due to their additive attentuation when operating at relatively nearby center frequencies. Curve 59 represents the attenuation of the filter as a function of frequency while curve 61 represents the return loss of the filter as a function of frequency. Horizontal lines 63 each represent a change of 5 dB for both curves while vertical lines 65 each represent a frequency change of 0.5 mhz.

The placement of the dielectric notch resonators at approximately 85% of one quarter wavelength of the center frequency of the bandwidth to be attenuated effectively reduces the non-attenuating interaction between the resonators.

As seen in FIGS. 5 and 6, the coupling transmission line 50 for achieving the response curve shown in FIG. 7 has a characteristic impedance of 50 ohms. The inner conductor 54 is circular in cross-section, having a diameter of 0.375 inch (0.95 cm) while the outer conductor 56 is square in cross-section. Male N-type flange mount connectors 58 are positioned on the transmission line for connection to the N type female bulkhead connectors 40 mounted on each dielectric notch resonator.

Standard coupling transmission line such as coaxial cable could also be used with somewhat higher losses. It is readily apparent to those of ordinary skill in the art that the coupling line can also be any other network whose transmission-phase response is an odd multiple of 90 degrees at the frequency of operation.

Different frequency bandwidths can be easily attenuated with the present invention by tuning the individual dielectric notch resonators to span the frequencies to be rejected. The present invention has the advantage over conventional filters in that it permits highly selective, low loss filters to be built in a much smaller area than would otherwise be possible.

It is therefore apparent that the dielectric notch filter according to the present invention is a high-quality factor attenuation filter operable over any desired frequency bandwidth with little attenuation outside of the selected area. The filter comprises one or more dielectric notch resonators, each having a center frequency adjusted so that the combination of resonators results in a response curve with a highly attenuated band about the desired attenuation bandwidth.

Although the present invention is particularly suited for use in the cellular communications art, it is also usable in other areas operating in the ultra-high frequency band as well as other frequencies. Due to the fact that the individual dielectric notch resonators are relatively small in comparison to other types of filtering devices for use at these frequencies, the present invention achieves a versatile and relatively small footprint filter for use in ultra-high frequency applications.

It will thus be seen at the object set forth above and those made apparent from the preceding description, are efficiently attained and, since certain things may be made in the construction of a dielectric notch filter as described herein without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what is claimed is:

1. A dielectric notch filter for attenuating the signal strength of an electromagnetic signal about a frequency bandwidth M, spanning frequencies $f_1$ to $f_2$, comprising P dielectric notch resonators, where P is an integer equal to or greater than one, wherein each dielectric resonator has an attenuation bandwidth N equal to or less than M and operable within frequencies $f_1$ to $f_2$, so that P times N is at least approximately equal to M, wherein each dielectric notch resonator comprises:

(A) a dielectric resonator formed from a high dielectric constant material, (B) a housing positioned about the dielectric resonator, (C) means for positioning the dielectric resonator within the volume defined by the housing so as to generate a resonate reactive impedance about a center frequency; and (D) a coupling reactance mechanism comprising:

(1) an inductive coupling wire, (2) a capacitive element connected to the coupling wire at one end and forming therewith a reactive element having an imaginary impedance component of approximately the same magnitude as the imaginary reactive component of the resonator at the center frequency of the dielectric resonator, with the imaginary component of the coupling mechanism reactance approximately 90 degrees out of phase with that of the dielectric resonator so as to effectively cancel the imaginary reactive component of the resonator reactance at the center frequency, and (3) means, connected at the second end of the coupling wire, for providing interconnection of the dielectric notch resonator with an external element; and E. a coupling transmission means to which each dielectric notch resonator is attached by said interconnecting means of the dielectric notch resonator, and further wherein the coupling of the dielectric notch resonators to the coupling transmission means is approximately at or less than the theoretical quarter wavelength of the center frequency of the desired attenuation bandwidth therein.

2. A dielectric notch filter as defined in claim 1, wherein the coupling transmission means is a coupling tranmission line.

3. A dielectric notch filter as defined in claim 2, wherein the transmission line has a characteristic impedance of 50 ohms.

4. A dielectric notch filter as defined in claim 3, wherein the transmission line comprises a circular cross-sectional center conductor and a square cross-sectioned outer conductor, and further wherein the dielectric medium is air.

5. A dielectric notch filter as defined in claim 4, further wherein each dielectric notch resonator comprises means for adjusting the center frequency of the resonator.

6. A dielectric notch filter as defined in claim 5, wherein for each dielectric notch resonator, the capacitive element is a variable capacitor and wherein variation of the capacitance of said capacitor adjusts the symmetry of the frequency response of the dielectric notch resonator with respect to the center frequency of the dielectric resonator.

7. A dielectric notch filter as defined in claim 6, wherein each dielectric resonator of each dielectric notch resonator is formed from a ceramic material.

8. A dielectric notch filter as defined in claim 7, wherein each dielectric resonator of each dielectric notch resonator is formed from zirconium tin titanate.

9. A dielectric notch filter as defined in claim 8, wherein for each dielectric notch resonator the means for positioning the dielectric resonator with respect to the volume defined by the housing is formed from a planar material having a low dielectric constant.

10. A dielectric notch filter as defined in claim 9, wherein the means for positioning the dielectric resonator of each dielectric notch resonator within the volume defined by the housing of the dielectric notch resonator is a planar material formed from crosslinked polystyrene.

11. A dielectric notch filter as defined in claim 10, wherein the dielectric resonator of each dielectric notch resonator is cylindrical in shape and the housing of each dielectric notch resonator is cylindrical in shape and approximately 2.75 times the diameter of the dielectric resonator.

12. A dielectric notch filter as defined in claim 11 for attenuating a bandwidth of frequencies centered at approximately 845.75 mhz, wherein P is equal to six and wherein the dielectric notch resonators have respective individual center frequencies of 845.3275 mhz, 845.4250 mhz, 845.6125 mhz, 845.8295 mhz, 846.0505 mhz and 846.2130 mhz and wherein each resonator is attached to the coupling transmission line at approximately 85% of the one-quarter wavelength of the center frequency of the attenuation band so as to result in a dielectric notch filter having an attenuation bandwidth of approximately 1.5 mhz about a center frequency of 845.75 mhz.

13. A dielectric notch filter as defined in claim 1, wherein for each dielectric notch resonator the means for providing interconnection with an external element comprises an N type female bulkhead connector and further wherein the coupling transmission line incorporates N type male flange connectors for mating with the N type female connectors of each dielectric notch resonator.

14. A dielectric notch filter as defined in claim 1, further wherein each dielectric notch resonator comprises means for adjusting the center frequency of the resonator.

15. A dielectric notch filter as defined in claim 14, wherein for each dielectric notch resonator, the capacitive element is a variable capacitor and wherein variation of the capacitance of said capacitor adjusts the symmetry of the frequency response of the dielectric notch resonator with respect to the center frequency of the dielectric resonator.

16. A dielectric notch filter as defined in claim 15, wherein each dielectric resonator of each dielectric notch resonator is formed from a material having a high dielectric constant.

17. A dielectric notch filter as defined in claim 16, wherein each dielectric resonator of each dielectric notch resonator is formed from a ceramic material.

18. A dielectric notch filter as defined in claim 17, wherein each dielectric resonator of each dielectric notch resonator is formed from zirconium tin titanate.

19. A dielectric notch filter as defined in claim 18, wherein for each dielectric notch resonator the means for positioning the dielectric resonator with respect to the volume defined by the housing is formed from a planar material having a low dielectric constant.

20. A dielectric notch filter as defined in claim 19, wherein the means for positioning the dielectric resonator of each dielectric notch resonator within the volume defined by the housing of the dielectric notch resonator is a planar material formed from crosslinked polystyrene.

21. A dielectric notch filter as defined in claim 20, wherein the dielectric resonator of each dielectric notch resonator is cylindrical in shape and the housing of each dielectric notch resonator is cylindrical in shape and approximately 2.75 times the diameter of the dielectric resonator.

22. A dielectric notch filter as defined in claim 21 for attenuating a bandwidth of frequencies centered at approximately 845.75 mhz, wherein P is equal to six and wherein the dielectric notch resonators have respective individual center frequencies of 845.3275 mhz, 845.4250 mhz, 845.6125 mhz, 845.8295 mhz, 846.0505 mhz and 846.2130 mhz and wherein each resonator is attached to the coupling transmission line at approximately 85% of the one-quarter wavelength of the center frequency of the attenuation band so as to result in a dielectric notch filter having an attenuation bandwidth of approximately 1.5 mhz about a center frequency of 845.75 mhz.

23. A dielectric notch filter for attenuating the signal strength of an electromagnetic signal about a frequency bandwidth M, spanning frequencies $f_1$ to $f_2$, comprising P dielectric notch resonators, where P is an integer equal to or greater than one, wherein each dielectric resonator has an attenuation bandwidth N equal to or less than M and operable within frequencies $f_1$ to $f_2$, so that P times N is at least approximately equal to M, wherein each dielectric notch resonator comprises:

(A) a dielectric resonator, (B) a housing positioned about the dielectric resonator, (C) means for positioning the dielectric resonator within the volume defined by the housing so as to generate a resonate reactive impedance about a center frequency; and (D) a coupling reactance mechanism comprising:

(1) means for producing an inductive impedance, (2) means for producing a capacitive impedance connected to the inductive impedance means and forming therewith a reactive element having an imaginary impedance component of approximately the same magnitude as the imaginary reactive component of the resonator at the center frequency of the dielectric resonator, with the imaginary component of the coupling mechanism reactance approximately 90 degrees out of phase with that of the dielectric resonator so as to effectively cancel the imaginary reactive component of the resonator reactance at the center frequency, and (3) means, connected to the reactive element, for providing interconnection of the dielectric notch resonator with an external element; and E. a coupling transmission means to which each dielectric notch resonator is attached by said interconnecting means of the dielectric notch resonator, and further wherein the coupling of the dielectric notch resonators to the coupling transmission means is approximately at or less than the theoretical quarter wavelength of the center frequency of the desired attenuation bandwidth therein.

24. A dielectric notch filler as defined in claim 23, wherein the coupling transmission means is a coupling transmission line.

25. A dielectric notch filter as defined in claim 24, wherein the transmission line has a characteristic impedance of 50 ohms.

26. A dielectric notch filter as defined in claim 25, wherein the transmission line comprises a circular cross-sectional center conductor and a square cross-sectioned outer conductor, and further wherein the dielectric medium is air.

27. A dielectric notch filter as defined in claim 26, further wherein each dielectric notch resonator comprises means for adjusting the center frequency of the resonator.

28. A dielectric notch filter as defined in claim 27, wherein for each dielectric notch resonator, the capacitive impedance means is a variable capacitor and wherein variation of the capacitance of said capacitor adjusts the symmetry of the frequency response of the dielectric notch resonator with respect to the center frequency of the dielectric resonator.

29. A dielectric notch filter as defined in claim 28, wherein each dielectric resonator of each dielectric notch resonator is formed from a material having a high dielectric constant.

30. A dielectric notch filter as defined in claim 30, wherein each dielectric resonator of each dielectric notch resonator is formed from a ceramic material.

31. A dielectric notch filter as defined in claim 30, wherein each dielectric resonator of each dielectric notch resonator is formed from zirconium tin titanate.

32. A dielectric notch filter as defined in claim 31, wherein for each dielectric notch resonator the means for positioning the dielectric resonator with respect to the volume defined by the housing is formed from a planar material having a low dielectric constant.

33. A dielectric notch filter as defined in claim 32, wherein the means for positioning the dielectric resonator of each dielectric notch resonator within the volume defined by the housing of the dielectric notch resonator is a planar material formed from cross-linked polystyrene.

34. A dielectric notch filter as defined in claim 33, wherein the dielectric resonator of each dielectric notch resonator is cylindrical in shape and the housing of each dielectric notch resonator is cylindrical in shape and approximately 2.75 times the diameter of the dielectric resonator.

35. A dielectric notch filter as defined in claim 34 for attenuating a bandwidth of frequencies centered at approximately 845.75 mhz, wherein P is equal to six and wherein the dielectric notch resonators have respective individual center frequencies of 845.3275 mhz, 845.4250 mhz, 845.6125 mhz, 845.8295 mhz, 846.0505 mhz and 846.2130 mhz and wherein each resonator is attached to the coupling transmission line at approximately 85% of the one-quarter wavelength of the center frequency of the attenuation band so as to result in a dielectric notch filter having an attenuation bandwidth of approximately 1.5 mhz about a center frequency of 845.75 mhz.

36. A dielectric notch filter as defined in claim 23, wherein for each dielectric notch resonator the means for providing interconnection with an external element comprises an N type female bulkhead connector and further wherein the coupling transmission line incorporates N type male flange connectors for mating with the N type female connectors of each dielectric notch resonator.

37. A dielectric notch filter as defined in claim 23, further wherein each dielectric notch resonator comprises means for adjusting the center frequency of the resonator.

38. A dielectric notch filter as defined in claim 37, wherein for each dielectric notch resonator, the capacitive impedance means is a variable capacitor and wherein variation of the capacitance of said capacitor adjusts the symmetry of the frequency response of the dielectric notch resonator with respect to the center frequency of the dielectric resonator.

39. A dielectric notch filter as defined in claim 38, wherein each dielectric resonator of each dielectric notch resonator is formed from a material having a high dielectric constant.

40. A dielectric notch filter as defined in claim 39, wherein each dielectric resonator of each dielectric notch resonator is formed from a ceramic material.

41. A dielectric notch filter as defined in claim 40, wherein each dielectric resonator of each dielectric notch resonator is formed from zirconium tin titanate.

42. A dielectric notch filter as defined in claim 41, wherein for each dielectric notch resonator the means for positioning the dielectric resonator with respect to the volume defined by the housing is formed from a planar material having a low dielectric constant.

43. A dielectric notch filter as defined in claim 42, wherein the means for positioning the dielectric resonator of each dielectric notch resonator within the volume defined by the housing of the dielectric notch resonator is a planar material formed from cross-linked polystyrene.

44. A dielectric notch filter as defined in claim 43, wherein the dielectric resonator of each dielectric notch resonator is cylindrical in shape and the housing of each dielectric notch resonator is cylindrical in shape and approximately 2.75 times the diameter of the dielectric resonator.

45. A dielectric notch filter as defined in claim 44 for attenuating a bandwidth of frequencies centered at approximately 845.75 mhz, wherein P is equal to six and wherein the dielectric notch resonators have respective individual center frequencies of 845.3275 mhz, 845.4250 mhz, 845.6125 mhz, 845.8295 mhz, 845.0505 mhz and 846.2130 mhz and wherein each resonator is attached to the coupling transmission line at approximately 85% of the one-quarter wavelength of the center frequency of the attenuation band so as to result in a dielectric notch filter having an attenuation bandwidth of approximately 1.5 mhz about a center frequency of 845.75 mhz.

* * * * *